US008578856B2

(12) United States Patent
Riess et al.

(10) Patent No.: US 8,578,856 B2
(45) Date of Patent: Nov. 12, 2013

(54) PARTIAL DECOMPOSITION PROJECTILE WITH A DOUBLE CORE

(75) Inventors: Heinz Riess, Fürth (DE); Erich Muskat, Roth (DE)

(73) Assignee: Ruag Ammotec GmbH, Furth (DE)

( * ) Notice: Subject to any disclaimer, the term of this patent is extended or adjusted under 35 U.S.C. 154(b) by 1323 days.

(21) Appl. No.: 10/567,089

(22) PCT Filed: Jul. 30, 2004

(86) PCT No.: PCT/EP2004/008588

§ 371 (c)(1),
(2), (4) Date: Aug. 6, 2009

(87) PCT Pub. No.: WO2005/017443

PCT Pub. Date: Feb. 24, 2005

(65) Prior Publication Data

US 2009/0293754 A1 Dec. 3, 2009

(30) Foreign Application Priority Data

Aug. 5, 2003 (DE) ..... 103 35 710
Jul. 21, 2004 (DE) ..... 10 2004 035 371

(51) Int. Cl.
*F42B 12/74* (2006.01)
*F42B 12/34* (2006.01)

(52) U.S. Cl.
USPC ..... 102/516; 102/506; 102/517

(58) Field of Classification Search
USPC ..... 102/506, 516, 517, 518
See application file for complete search history.

(56) References Cited

U.S. PATENT DOCUMENTS

| | | | | |
|---|---|---|---|---|
| 4,939,996 | A | 7/1990 | Dinkha et al. | |
| 7,150,233 | B1 * | 12/2006 | Eberhart | 102/516 |
| 7,404,359 | B2 * | 7/2008 | Muskat et al. | 102/516 |
| 7,509,911 | B2 * | 3/2009 | Muskat et al. | 102/516 |
| 8,141,494 | B2 * | 3/2012 | Riess et al. | 102/516 |

FOREIGN PATENT DOCUMENTS

| | | |
|---|---|---|
| DE | 102 39 910 | 10/2003 |
| EP | 0 997 700 | 5/2000 |
| WO | WO 97/20185 | 6/1997 |
| WO | WO 00/73728 | 12/2000 |

* cited by examiner

*Primary Examiner* — James Bergin
(74) *Attorney, Agent, or Firm* — Antonelli, Terry, Stout & Kraus, LLP.

(57) ABSTRACT

The decomposition of a projectile in a target body, particularly a hunting projectile in wild animals after penetration therein, determines the energy output of the projectile and thereby the effect of the shot. For projectiles with double cores, the properties of the ingredients used in the cores decisively affect the decomposition and particularly the deformation behavior of the cores. According to the invention, a partial decomposition projectile comprising two cores is provided with one solid core (3) made of a material suited to said projectile and the other core (4;22) is divided up into two areas (4*a*,4*b*;22*a*;22*b*), whereby one area (4*a*;22*a*) is made of ball-shaped elements made of a metal material granulate (5;23) and the second area (4*b*;22*b*) is made of a metal or ceramic powder and the ball-shaped elements or granulates (5;23) are pressed to become free of shrink holes, in order to improve decomposition behavior control.

28 Claims, 2 Drawing Sheets

PARTIAL DECOMPOSITION PROJECTILE WITH A DOUBLE CORE

The invention relates to a disintegrating bullet according to the preamble of the first claim.

The disintegration of a bullet in the target body, in particular of a hunting bullet in the body of game animals following penetration thereof, determines the energy released by the bullet and hence the effect of the shot. A different form of disintegration is necessary in the case of weak game, for example, to that required for high game. DE 102 39 910 A1 discloses a disintegrating hunting bullet in the form of a jacketed bullet. It may be both a partially jacketed and a fully jacketed bullet, the bullet core of which consists of balls or granules, compressed without cavities, made from a metallic material. Suitable materials for the balls or granules include any materials, for example lead or lead-containing alloys, that may be compressed to form a core without cavities. For reasons of environmental protection, to advantageously prevent the contamination of soil and game, lead-free materials are preferably used.

The compressed bullet core, which consists of balls or granules and is held by the bullet jacket, disintegrates, along with the bullet jacket, on impact in the target body. The diameter of the balls or the particle size of the granules determines both the released energy and the predetermined breaking points in the bullet core, and thus the size of the individual parts produced when said core disintegrates. Larger balls or granule particles penetrate the target medium more deeply and produce a further-reaching destructive channel in the tissue than a number, comparable in terms of mass, of smaller balls or granule particles. As a result of the compression of the material of the core, sharp edges, which increase the effectiveness of the fragments, are obtained on the compressed balls or granule particles.

WO 01/20244 A1 and WO 01/20245 A1 disclose deformable bullets consisting respectively of two solid cores, one core being what is known as the penetrator, which is arranged in the tail or in the nose of the bullet and significantly affects the disintegration and, in particular, the deformation characteristics of the bullet. In the case of these bullets, a slight loss in mass of the cores and an expulsion, with a defined residual size of the bullet, occur.

The object of the invention is further to improve the disintegration characteristics of a bullet thus constructed.

The object is achieved in that the bullets according to the invention comprise a respective solid core, i.e. a core made from solid material, in the tail or in the nose of the bullet and a second core, which is located before or after the solid core, is not solid and is further divided into one, two or more regions.

If the first core consists of balls or granules compressed without cavities, the position of the second region, of the powder compressed without cavities, may be located, viewed in the direction of the shot, before or after the part consisting of balls or granules compressed without cavities. The two regions may be compressed together or individually. The balls or granule particles and the powder may be made from different materials, which may also differ from the material of the solid core, although the optimal position of the centre of gravity, with respect to the ballistics, has to be ensured in the configuration of the cores.

Depending on the calibre, the size of the balls or granules is between 1 mm and 12 mm, preferably between 3 mm and 6 mm. The balls having the largest diameter are used, for example, at .50 calibre. Suitable materials for the balls and the granules include any metallic materials that may be compressed without cavities and are suitable as bullet materials. In the core region consisting of balls or granules, balls or granule particles of different sizes may also be compressed together. The sizes may be coordinated in such a way that the small balls or granule particles fill the gaps between the large balls or particles.

The particle size of the powder is determined by the desired energy release and deep action of the individual powder particles in the target body. Large powder particles have a high degree of deep action, while small powder particles have only a low degree of deep action, in particular in the body of game animals. The particle size of the powder is between 50 μm and 1 mm. The compacting pressure is determined by the particle size and is preferably between 1.5 and 4 tonnes. Sintered materials and binders are also advantageous, wherein, in the case of materials that are relatively difficult to compress, binders may be provided as fillers between the compressed materials.

Prior to the compression process, the balls or granule particles may be coated with a separating substance to ensure more effective disintegration in the target. Examples of suitable separating agents include graphite or polytetrafluoroethylene (Teflon).

The bullet cores consisting of balls or granules may be compressed in the bullet jacket or be introduced into the bullet jacket in prefabricated form, i.e. precompressed into the bullet shape without cavities.

The bullet cores may be introduced and compressed individually in any desired order. A construction of the core with clear separation between the various compressed core regions is thus obtained.

The solid core may consist of compressed balls or granules, although the compression process must be very intensive and without cavities. A solid core consisting of highly compacted sintered materials is also possible.

The bullet comprising a compact core and a compressed core may also consist merely of a disintegratable material such as balls, granules or powder.

Predetermined breaking points in the jacket are advantageous if disintegration of the bullet is desired immediately on impact or at low penetration depth or at relatively low projectile speeds. The predetermined breaking points extend in the axial direction and are located on the inside of the jacket, preferably in the ogival region. The disintegration of the bullet can be affected by the number and the position of the predetermined breaking points in the jacket. The closer toward the tip of the bullet the predetermined breaking points are located, the more the jacket swells and is disintegrated into fragments. Further predetermined breaking points may be notches extending radially on the outer perimeter, for example a sharp edge in the case of hunting bullets. A tearing edge, for example a sharp edge, at the junction with the solid core causes the jacket to become torn off. Holding grooves, on the other hand, cause the bullet jacket to be secured to the bullet core.

Suitable materials for the jacket include, in particular, copper, alloys thereof, plated steel, soft iron and zinc/tin alloys.

The described construction of the bullet core is suitable for all disintegratable bullet types. The possibilities indicated for configuring the core of a bullet allow bullets to be produced that are adapted to the respective purpose of use and that achieve a respective optimal effect at any impact speed owing to their disintegration characteristics, which are adapted to this speed.

The invention will be described in greater detail with reference to embodiments.

Figure 5:
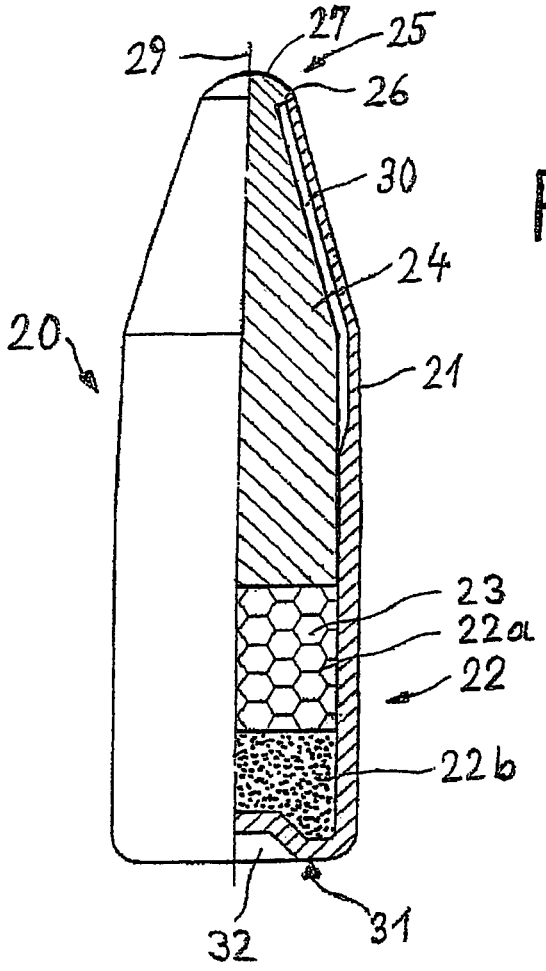
Figure 6:
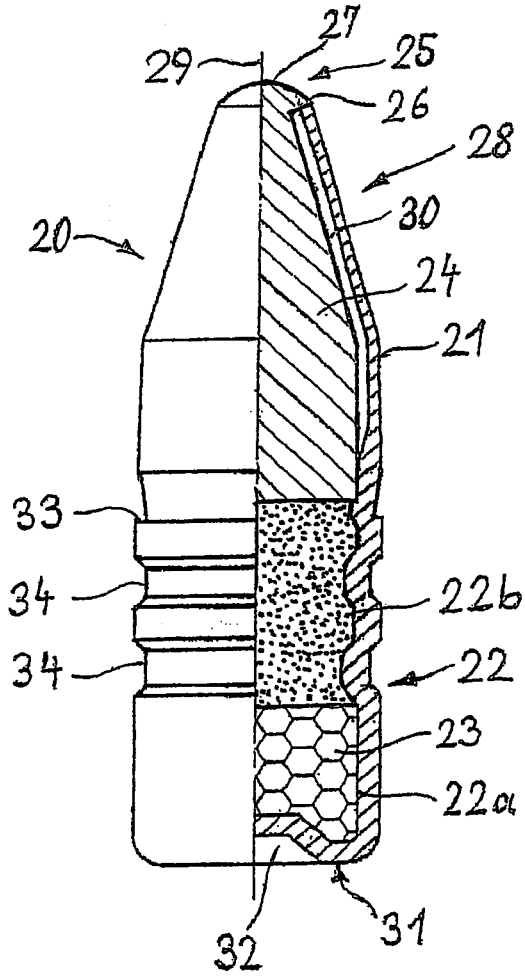

FIG. 5 is a schematic view, half in section, of a partially jacketed bullet in the form of a disintegrating bullet comprising a solid nose core and a tail core, which is again divided into two partial regions, of which the tail region consists of powder and the preceding region consists of balls or granules, respectively compressed without cavities; and FIG. 6 is a schematic view, half in section, of a partially jacketed bullet, the core arrangement corresponding to FIG. 5, in which the jacket additionally contains a sharp edge and two holding grooves.

Figure 1:
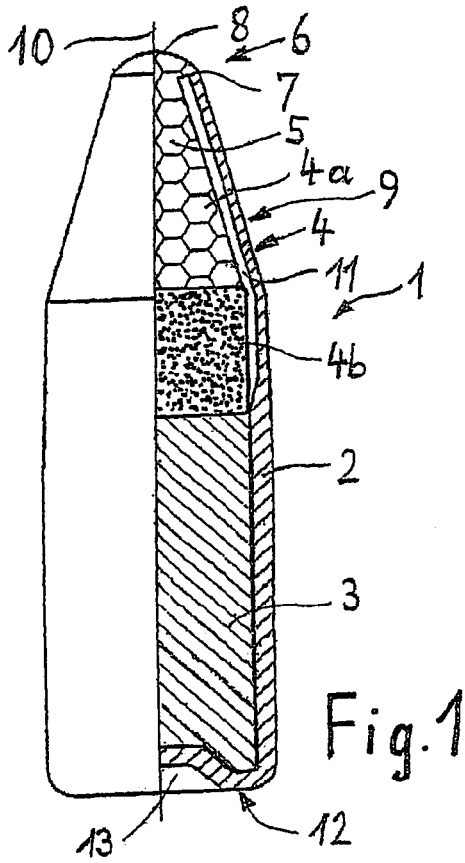
FIG. 1 is a schematic view, half in section, of a partially jacketed bullet in the form of a disintegrating bullet comprising a solid tail core and a nose core, which is divided into two partial regions, of which the tip region consists of balls or granules and the subsequent region consists of powder, each compressed without cavities.

FIG. 1 shows a partially jacketed bullet 1. A solid core 3, which is made from a material suitable for a bullet core, was inserted into the bullet jacket 2, which is initially non-deformed and open. The core material of the second of the two regions 4*a* and 4*b*, the nose core 4, was then added. The region of the nose core 4 that is located toward the bullet tip 8, the region 4*a*, consists of balls or granules, compressed without cavities. The subsequent region 4*b* consists of powder compressed without cavities. The two regions 4*a* and 4*b* are each precompressed individually into their shapes and then inserted into the bullet jacket 2. They may also be compressed directly in the jacket.

The bullet jacket 2 was then drawn in onto the illustrated bullet shape. The bullet jacket 2 is not closed in the bullet nose 6. The bullet core 3 protrudes from the opening 7 in the jacket 2 and forms the bullet tip 8. In the ogival region 9, predetermined breaking points, in the form of grooves 11 pressed into the jacket 2, extend on the inside of the jacket 2 in the direction of the axis 10 of the bullet 1. A spherical indentation 13 is located in the tail 12 of the bullet 1 for stabilising the motion of the bullet and thus for increasing precision.

Figure 2:
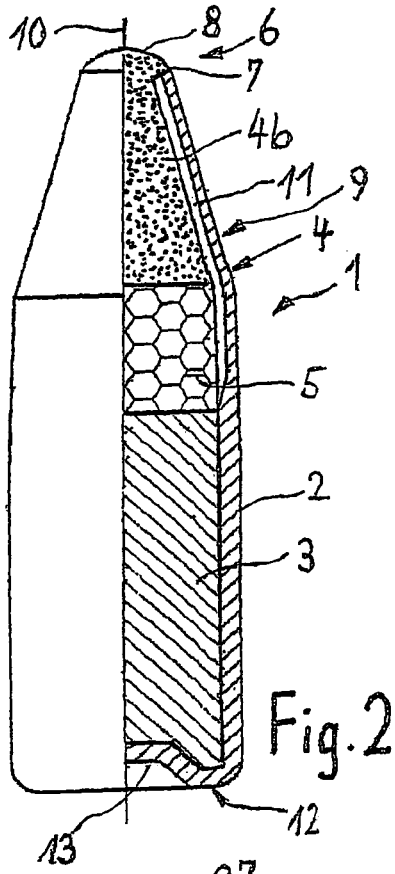
FIG. 2 is a schematic view, half in section, of a partially jacketed bullet in the form of a disintegrating bullet comprising a solid tail core and a nose core, which is again divided into two partial regions, of which the tip region consists of powder and the subsequent region of balls or granules, each compressed without cavities.

The embodiment according to FIG. 2 also has a nose core 4, which is divided into two regions. The difference from the preceding embodiment is that, in this case, the arrangement of the region 4*a*, which consists of balls or granules compressed without cavities, has been replaced by 4*b*, which consists of powder compressed without cavities. The region 4*b* forms the bullet tip 8.

The function of all of the described bullets consists in the fact that the compact core produces the desired expulsion, the balls or the granules allow a high degree of deep action in the body of game animals, and the powder causes a high shock effect.

The size ratios of the individual compressed core parts are adapted to the bullet weight, the calibre and the desired effect in the body of game animals.

EXAMPLES a) A high degree of deep action is desired. The following are advantageous:

compact core for the expulsion
high ball or granule content
low powder content b) A deep action for heavy game is desired. The following are advantageous:

large compact core for the expulsion
high content of balls or granules
low content of powder c) A high shock effect is desired. The following are advantageous:

compact core for the expulsion
high content of powder
low content of balls or granules Following impact in the target body, the bullet jacket opens, the compressed core disintegrates into its individual parts and releases the desired energy to the game. Owing to the compressed core, the same energy is released in the game with each bullet. The disintegration of this type of bullet is independent of the impact speed, because the compressed core disintegrates both at high impact speed and at low impact speed. In cores made from sintered materials or comprising binders in the compressed core, the disintegration of the core may be controlled by the sintered density or the binder content.

The size ratios of the cores are determined by the desired shock effect and deep action in the body of game animals. If 50% of the core consists of compressed powder, a high shock effect with deep action is obtained, depending on the size of the powder particles. If 20% of the core consists of compressed powder, a low shock effect with deep action is obtained. The game is killed as a function of the size of the powder particles.

Figure 3:
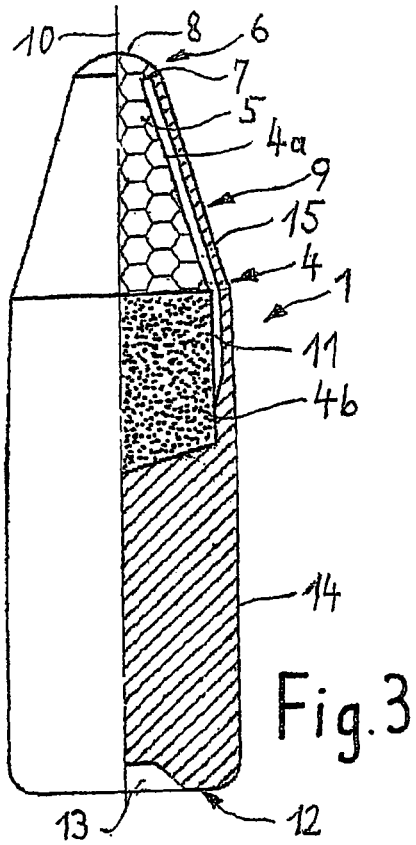
FIG. 3 is a schematic view, half in section, of a partially jacketed bullet in the form of a disintegrating bullet, the core arrangement corresponding to FIG. 1, the jacket and the tail core being integral.

The embodiment according to FIG. 3 is comparable with that according to FIG. 1. The difference is that the tail core 14 and the jacket 15 are integral. The jacket 15 has been formed, by deep-drawing, from the material of the tail core 14 and surrounds the nose core 4 comprising the two regions 4*a* and 4*b*, the region 4*b* forming the bullet tip 8. The function is as in the embodiments according to FIGS. 1 and 2.

Figure 4:
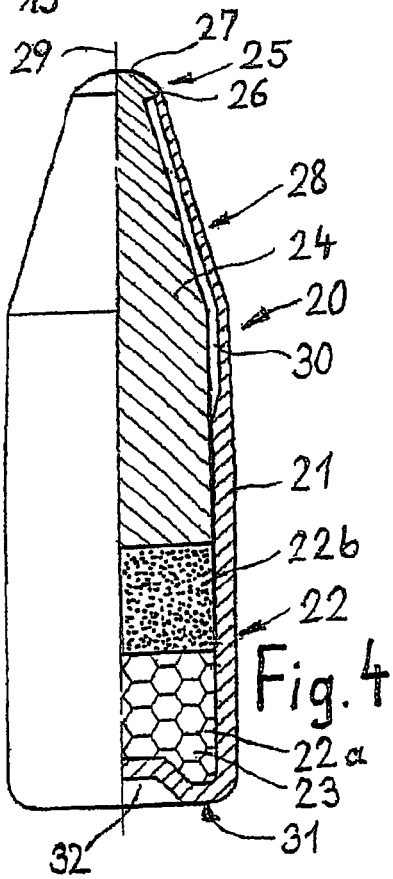
FIG. 4 is a schematic view, half in section, of a partially jacketed bullet in the form of a disintegrating bullet comprising a solid nose core and a tail core, which is divided into two partial regions, of which the tail region consists of balls or granules and the preceding region consists of powder, each compressed without cavities.

The embodiment according to FIG. 4 differs from the preceding embodiments basically in that the nose core is the solid core. The bullet 20 is also a partially jacketed bullet. The core material of the tail core 22 was initially added to the bullet jacket 21, which is initially non-deformed and open. The tail core is divided into two regions. The region 22*a*, which is located toward the tail 30, consists of balls or granules, compressed without cavities. The subsequent region 22*b* consists of powder compressed without cavities. The two regions 22*a* and 22*b* were each precompressed individually into their shapes and then inserted into the bullet jacket 21. The solid core 24, which is made from a suitable material for a bullet core, is then inserted as the nose core, and the bullet jacket 21 is drawn onto the illustrated bullet shape. The bullet jacket 21 is not closed in the bullet nose 25. The bullet core 24 protrudes from the opening 26 in the jacket 21 and forms the bullet tip 27. In the ogival region 28, predetermined breaking points, in the form of grooves 30 pressed into the jacket 21, extend on the inside of the jacket 21 in the direction of the axis 29 of the bullet 20. A spherical indentation 32 is located in the tail 31 of the bullet 20 for stabilising the motion of the bullet and thus for increasing precision.

This type of bullet is comparable with a "penetrator". The function differs from FIGS. 1, 2 and 3 in that the compressed core comprising powder, balls or granules becomes effective only once the bullet jacket has disintegrated and releases the compressed core.

The embodiment according to FIG. 5 also has a tail core 22, which is divided into two regions. The difference from the preceding embodiment is that, in this case, the arrangement of the region 22*a*, which consists of balls or granules compressed without cavities, has been replaced by 22*b*, which consist of powder compressed without cavities.

A tearing edge causes the material to become torn off at the junction with the solid core. Holding grooves cause the bullet jacket to be secured to the bullet core.

The embodiment according to FIG. 6 is comparable with that according to FIG. 4. The difference is that the bullet jacket 21 has further features. What is known as a sharp edge 33, a notch, located on the outer perimeter of the jacket 21, with a sharp edge, which, in the case of hunting bullets, both causes a clean incision into the hide of the game animal and forms a further predetermined breaking point for the disintegration of the jacket 21, is located in the cylindrical region of the bullet 20. Two further holding grooves 34 are also located on the perimeter of the jacket 21. The core is fixed by deformation of the jacket. These holding grooves 34 also help to reduce friction in the gun barrel. The additional features of the bullet jacket are not restricted to the present embodiment. The embodiments of FIG. 1 to 5 may also be configured with a sharp edge and/or at least one holding groove.

The invention claimed is:

1. Disintegrating bullet, in the form of a jacketed bullet, the bullet selected from the group consisting of: (A), (B), (C), and (D);

wherein (A) includes:

a first core and a second core, the first core being a solid core disposed before the second core in a firing direction, wherein the second core includes a first region and a second region each compressed without cavities, the first region being disposed before the second region in the firing direction, and wherein the first region includes at least one of metallic balls and metallic granules, and the second region includes at least one of a metallic powder and a ceramic powder, and a jacket, configured to substantially envelop at least the second core;

wherein (B) includes:

a first core and a second core, the first core being a solid core disposed before the second core in a firing direction, wherein the second core includes a first region and a second region each compressed without cavities, the first region being disposed after the second region in the firing direction, and wherein the first region includes at least one of metallic balls and metallic granules, and the second region includes at least one of a metallic powder and a ceramic powder, and a jacket, configured to substantially envelop at least the second core;

wherein (C) includes:

a first core and a second core, the first core being a solid core disposed after the second core in a firing direction, wherein the second core includes a first region and a second region each compressed without cavities, the first region being disposed before the second region in the firing direction, and wherein the first region includes at least one of metallic balls and metallic granules, and the second region includes at least one of a metallic powder and a ceramic powder, and a jacket, configured to substantially envelop at least the second core; and wherein (D) includes:

a first core and a second core, the first core being a solid core disposed after the second core in a firing direction, wherein the second core includes a first region and a second region each compressed without cavities, the first region being disposed after the second region in the firing direction, and wherein the first region includes at least one of metallic balls and metallic granules, and the second region includes at least one of a metallic powder and a ceramic powder, and a jacket, configured to substantially envelop at least the second core.

2. Disintegrating bullet according to claim 1, selected from the group consisting of: (C) and (D); and wherein the first core forms the tail of the bullet.

3. Disintegrating bullet according to claim 2, selected from the group consisting of: (C); and wherein, in the second core, the first region forms the bullet tip and the second region when viewed in the direction of flight of the bullet, follows the first region.

4. Disintegrating bullet according to claim 2, selected from the group consisting of: (D); and wherein, in the second core, the second region forms the bullet tip and the first region, when viewed in the direction of flight of the bullet, follows the second region.

5. Disintegrating bullet according to claim 1, selected from the group consisting of: (A) and (B); and wherein the first core is arranged in the nose of the bullet and forms the bullet tip.

6. Disintegrating bullet according to claim 5, selected from the group consisting of: (B); and wherein, in the second core, the first region forms the tail and the second region is arranged, when viewed in the direction of flight of the bullet, before the first region.

7. Disintegrating bullet according to claim 5, selected from the group consisting of: (A); and wherein, in the second core, the second region forms the tail and the first region is arranged, when viewed in the direction of flight of the bullet, before the second region.

8. Disintegrating bullet according to claim 1, selected from the group consisting of: (A), (B), (C), and (D); and wherein the size of the balls or the granules is between 1 mm and 12 mm, preferably between 3 mm and 6 mm.

9. Disintegrating bullet according to claim 1, selected from the group consisting of: (A), (B), (C), and (D); and wherein the particle size of the powder is between 5 μm and 1 mm.

10. Disintegrating bullet according to claim 1, selected from the group consisting of: (A), (B), (C), and (D); and wherein when powder is compressed, it is mixed with binders or with cavity-filling material.

11. Disintegrating bullet according to claim 1, selected from the group consisting of: (A), (B), (C), and (D); and wherein, in the first region of the second core, different sizes of at least one of balls and granule particles are compressed together.

12. Disintegrating bullet according to claim 11, selected from the group consisting of: (A), (B), (C), and (D); and wherein the sizes of at least one of balls and granule particles are coordinated in such a way that at least one of small balls and small granule particles fill the gaps between at least one of large balls and large granule particles.

13. Disintegrating bullet according to claim 1, selected from the group consisting of: (A), (B), (C), and (D); and wherein the first region of the second core is made from a material or materials different from the material of the first core.

14. Disintegrating bullet according to claim 1, selected from the group consisting of: (A), (B), (C), and (D); and wherein the first region of the second core is made from a material or materials different than the second region of the second core.

15. Disintegrating bullet according to claim 1, selected from the group consisting of: (A), (B), (C), and (D); and wherein at least one of balls and granules are coated with a separating substance.

16. Disintegrating bullet according to claim 15, selected from the group consisting of: (A), (B), (C), and (D); and wherein the separating substance includes at least one of graphite and polytetrafluoroethylene.

17. Disintegrating bullet according to claim 1, selected from the group consisting of: (A), (B), (C), and (D); and wherein at least the second core is in a prefabricated form before being introduced into the jacket.

18. Disintegrating bullet according to claim 1, selected from the group consisting of: (A), (B), (C), and (D); and wherein the jacket has a predetermined breaking point.

19. Disintegrating bullet according to claim 18, selected from the group consisting of: (A), (B), (C), and (D); and wherein the predetermined breaking point extends in the direction of the bullet axis.

20. Disintegrating bullet according to claim 1, selected from the group consisting of: (A), (B), (C), and (D); and wherein the material of the jacket includes at least one of copper, an alloy thereof, plated steel, soft iron and zinc/tin alloys.

21. Disintegrating bullet according to claim 1, selected from the group consisting of: (A), (B), (C), and (D); and wherein the bullet has a spherical indentation in a tail region.

22. Disintegrating bullet according to claim 1, selected from the group consisting of: (A), (B), (C), and (D); and wherein the bullet has a sharp edge on the outer perimeter of the bullet.

23. Disintegrating bullet according to claim 1, selected from the group consisting of: (A), (B), (C), and (D); and wherein the bullet has holding grooves on the outer perimeter of the bullet.

24. Disintegrating bullet according to claim 1, selected from the group consisting of: (A), (B), (C), and (D); and wherein the contents of the first region of the second core is selected from the group consisting of: metallic balls, metallic granules, and a combination of metallic balls and metallic granules; and wherein the contents of the second region of the second core is selected from the group consisting of: a metallic powder, a ceramic powder, and a combination of a metallic powder and a ceramic powder.

25. Disintegrating bullet according to claim 24, selected from the group consisting of: (A), (B), (C), and (D); and wherein the contents of the first region of the second core consists of metallic granules, and the contents of the second region of the second core consists of a metallic powder.

26. Disintegrating bullet according to claim 24, selected from the group consisting of: (A), (B), (C), and (D); and wherein the contents of the first region of the second core consists of metallic granules, and contents of the second region of the second core consists of a ceramic powder.

27. Disintegrating bullet according to claim 24, selected from the group consisting of: (A), (B), (C), and (D); and wherein the contents of the first region of the second core consists of metallic balls, and the contents of the second region of the second core consists of a ceramic powder.

28. Disintegrating bullet according to claim 24, selected from the group consisting of: (A), (B), (C), and (D); and wherein the contents of the first region of the second core consists of metallic balls, and the contents of the second region of the second core consists of a metallic powder.

* * * * *